US010344403B2

(12) United States Patent
Taylor

(10) Patent No.: US 10,344,403 B2
(45) Date of Patent: Jul. 9, 2019

(54) DENSIFICATION OF POLYACRYLONITRILE FIBER

(71) Applicant: Cytec Industries Inc., Woodland Park, NJ (US)

(72) Inventor: Thomas B Taylor, Greenville, SC (US)

(73) Assignee: Cytec Industries Inc., Woodland Park, NJ (US)

( * ) Notice: Subject to any disclaimer, the term of this patent is extended or adjusted under 35 U.S.C. 154(b) by 457 days.

(21) Appl. No.: 14/980,547

(22) Filed: Dec. 28, 2015

(65) Prior Publication Data

US 2016/0186365 A1 Jun. 30, 2016

Related U.S. Application Data

(60) Provisional application No. 62/097,391, filed on Dec. 29, 2014.

(51) Int. Cl.

| | |
|---|---|
| ***D01F 9/22*** | (2006.01) |
| ***D01D 5/14*** | (2006.01) |
| ***D01D 5/06*** | (2006.01) |

(52) U.S. Cl.

CPC ..... *D01F 9/225* (2013.01); *D01D 5/06* (2013.01); *D01D 5/14* (2013.01); *D01F 9/22* (2013.01); *D10B 2101/12* (2013.01)

(58) Field of Classification Search

CPC ..... D01F 9/225

See application file for complete search history.

(56) References Cited

U.S. PATENT DOCUMENTS

| | | | | |
|---|---|---|---|---|
| 6,221,490 | B1 | 4/2001 | Matsuhisa et al. | |
| 6,428,891 | B1 | 8/2002 | Okuya et al. | |
| 6,428,892 | B2 | 8/2002 | Matsuhisa et al. | |
| 6,569,523 | B2 | 5/2003 | Ikeda et al. | |
| 6,569,524 | B2 | 5/2003 | Kawai et al. | |
| 7,749,479 | B2 | 7/2010 | Leon y Leon | |
| 8,236,273 | B2 | 8/2012 | Oyama et al. | |
| 8,372,323 | B2 | 2/2013 | Wilkinson | |
| 8,801,985 | B2 | 8/2014 | Ikeda et al. | |
| 2001/0024722 | A1 | 9/2001 | Matsuhisa et al. | |
| 2012/0088104 | A1* | 4/2012 | Hashimoto | D01F 6/18 428/398 |

FOREIGN PATENT DOCUMENTS

| | | |
|---|---|---|
| EP | 2441865 | 4/2012 |
| JP | S4957118 A | 6/1974 |
| JP | 2008308776 | 12/2008 |
| JP | 2010285710 | 12/2010 |

OTHER PUBLICATIONS

International Search Report. PCT/US2015/067639, dated May 9, 2016.

* cited by examiner

*Primary Examiner* — Larry W Thrower
(74) *Attorney, Agent, or Firm* — Thi Dang

(57) ABSTRACT

Provided herewith is a process for improving tensile strength of precursor PAN fiber during the spinning stage in the manufacturing process. According to the process of the present invention, precursor fiber is made denser as it enters each wash bath. This progressive densification approach is useful for all PAN precursor bath draw/wash processes where a need for careful control of fiber network density and structure is required for improved carbon fiber properties.

4 Claims, 3 Drawing Sheets

1 - spinning solution
2 - filtration
3 - spinnerette
4 - air gap
5 - coagulation bath
6 - driven rollers
7 - washing bath(s)
8 - spin finish application
9 - stretching bath(s)
10 - drying, collapsing, and heat setting
11 - traversing takeup 1 - spinning solution
2 - filtration
3 - spinnerette
4 - air gap
5 - coagulation bath
6 - driven rollers
7 - washing bath(s)
8 - spin finish application
9 - stretching bath(s)
10 - drying, collapsing, and heat setting
11 - traversing takeup

DENSIFICATION OF POLYACRYLONITRILE FIBER

This application claims the benefit of pending U.S. patent application Ser. 62/097,391 filed Dec. 29, 2014.

BACKGROUND OF THE INVENTION

The present disclosure relates generally to a method of increasing the network density or reducing the porosity of polyacrylonitrile fiber. More particularly, the present disclosure relates to carbon fibers having improved tensile strength and tensile modulus.

Carbon fibers have been used in a wide variety of applications because of their desirable properties, such as high strength and stiffness, high chemical resistance and low thermal expansion. For example, carbon fibers can be formed into a structural part that combines high strength and high stiffness, while having a weight that is significantly lighter than a metal component of equivalent properties. Increasingly, carbon fibers are being used as structural components in composite materials for aerospace applications. In particular, composite materials have been developed wherein carbon fibers serve as a reinforcing material in a resin or ceramic matrix.

In order to meet the rigorous demands of the aerospace and auto industries, it is necessary to continually develop new carbon fibers having both high tensile strength (about 1,000 ksi or greater) and high modulus of elasticity (about 50 Msi or greater), as well as having no surface flaws or internal defects. Carbon fibers having individually higher tensile strength and modulus can be used in fewer quantities than lower strength carbon fibers and still achieve the same total strength for a given carbon fiber-reinforced composite part. As a result, the composite part containing the carbon fibers weighs less. A decrease in structural weight is important to the aerospace and auto industries because it increases the fuel efficiency and/or the load carrying capacity of the aircraft or auto incorporating such a composite part.

Carbon fiber from acrylonitrile is generally produced by six manufacturing steps or stages. Acrylonitrile monomer is first polymerized by mixing it with another co-monomer (e.g., methyl acrylate or methyl methacrylate) and reacting the mixture with a catalyst in a conventional suspension or solution polymerization process to form polyacrylonitrile (PAN) polymer solution (spin "dope"). PAN, containing 68% carbon, is currently the most widely used precursor for carbon fibers.

Once polymerized, the PAN dope is spun into precursor (acrylic) fibers using one of several different methods. In one method (dry spinning), the heated dope is pumped (filtered) through tiny holes of a spinnerette into a tower or chamber of heated inert gas where the solvent evaporates, leaving a solid fiber.

In another method (wet spinning), the heated polymer solution ("spinning dope") is pumped through tiny holes of a spinnerette into a coagulation bath where the spinning dope coagulates and solidifies into fibers. Wet spinning can be further divided into one of the minor processes of wet-jet spinning, wherein the spinnerette is submerged in the coagulation bath; air gap or dry jet spinning, wherein the polymer jets exit the spinnerette and pass through a small air gap (typically 2-10 mm) prior to contacting the coagulation bath; and gel spinning, wherein the dope is thermally induced to phase change from a fluid solution to a gel network. In both dry and wet spinning methods, the fiber is subsequently washed and stretched through a series of one or more baths.

After spinning and stretching the precursor fibers and before they are carbonized, the fibers need to be chemically altered to convert their linear molecular arrangement to a more thermally stable molecular ladder structure. This is accomplished by heating the fibers in air to about 390-590° F. (about 200-300° C.) for about 30-120 minutes. This causes the fibers to pick up oxygen molecules from the air and rearrange their atomic bonding pattern. Oxygenation or stabilization can occur by a variety of processes, such as drawing the fibers through a series of heated chambers or passing the fibers over hot rollers.

After oxygenation, the stabilized precursor fibers are heated to a temperature of about 1800-5500° F. (about 1000-3000° C.) for several minutes in one or two furnaces filled with a gas mixture free of oxygen. As the fibers are heated, they begin to lose their non-carbon atoms in the form of various gases such as water vapor, hydrogen cyanide, ammonia, carbon monoxide, carbon dioxide, hydrogen and nitrogen. As the non-carbon atoms are expelled, the remaining carbon atoms form tightly bonded carbon crystals that are aligned parallel to the long axis of the fiber.

The resultant carbon fibers have a surface that does not bond well with the epoxies and other materials used in composite materials. To give the fibers better bonding properties, their surface is slightly oxidized. The addition of oxygen atoms to the surface provides better chemical bonding properties and also removes weakly bound crystallites for better mechanical bonding properties.

Once oxidized, the carbon fibers are coated ("sized") to protect them from damage during winding or weaving. Sizing materials that are applied to the fibers are typically chosen to be compatible with the epoxies used to form composite materials. Typical sizing materials include epoxy, polyester, nylon, urethane and others.

High modulus of carbon fibers comes from the high crystallinity and the high degree of alignment of crystallites in the fiber direction, while the strength of carbon fibers is primarily affected by the defects and crystalline morphologies in fibers. It is believed that increasing heat treatment temperatures to develop a larger and better aligned graphitic structure can improve Young's modulus while removing flaws has the potential to improve fiber strength.

During the spinning process, the acrylic fiber precursor network density can be estimated by making swelling measurements after the coagulation bath and after each washing or drawing bath. The swelling test method involves collecting a wet fiber sample, washing the sample in deionized water, centrifuging the sample to remove surface liquid, and then measuring the weight of the washed and centrifuged sample ($W_a$). The sample is then dried in an air circulating oven and then re-weighed to measure the dry fiber weight ($W_f$). The degree of swelling is then calculated using the following formula:

$$\text{Degree of swelling (\%)}=(W_a-W_f)\times(100/W_f)$$

A lower swelling value for a fiber sample typically indicates lower porosity or an increase in fiber network density.

It has been observed that fiber swelling values as measured above do not always decrease as the fiber progresses from the coagulation bath through the washing and drawing baths. In most cases, fiber swelling measurements tend to increase in the first wash/draw bath before they begin decreasing in subsequent baths. This is indicative of a decrease in fiber network density in the first wash/draw bath relative to fiber network density at the coagulation bath exit.

This loss in density is a potential defect in the fiber in that it can negatively affect the tensile strength of the final carbon fiber product.

Attempts have been made to densify drawn precursor fibers by keeping the drawing temperatures of the baths as high as possible. Maximum bath temperatures of 80° C. to 100° C., with the number of draw baths being two or greater, have been used. Hotter draw bath temperatures are beneficial for stretching precursor fiber and for accelerating solvent removal but can result in fiber sticking damage. Further, such techniques for achieving densification tend to make the fiber structure too dense resulting in lower oxygen permeability into the fibers during the stabilization stage, resulting in reduced tensile strength.

SUMMARY OF THE INVENTION

Provided herewith is a process for improving tensile strength of precursor PAN fiber during the spinning stage in the manufacturing process. According to the process of the present invention, precursor fiber is made denser as it enters each wash bath. This progressive densification approach is useful for all PAN precursor bath draw/wash processes where a need for careful control of fiber network density and structure is required for improved carbon fiber properties.

In one embodiment, the process for producing carbon fibers includes spinning an acrylic polymer, thereby forming acrylic fibers of single filaments; drawing the acrylic fibers in two or more baths, wherein in one or more baths the acrylic fibers are stretched and in a last bath the fiber is relaxed; and stabilizing and subsequently carbonizing the acrylic fibers.

Further, the process provides a tensile modulus of the carbonized acrylic fibers that is higher than that of carbonized acrylic fibers wherein the acrylic fibers are stretched in the last bath.

The process further includes the step of setting the temperature of the first bath so that fiber density as measured by swelling of the acrylic fibers upon exit from the first bath is less than or equal to the fiber density as measured by swelling of the acrylic fibers upon exit of the fiber from the coagulation bath.

In another embodiment, a process for producing carbon fibers is provided that includes spinning an acrylic polymer, thereby forming acrylic fibers of single filaments; drawing the acrylic fibers in two or more baths, wherein the temperature of the two or more bath is such that fiber network density as measured by swelling of the acrylic fibers upon exit from a bath is less than or equal to the fiber density as measured by swelling of the acrylic fibers upon exit of the fiber from the previous bath; and stabilizing and subsequently carbonizing the acrylic fibers.

With this process, the tensile strength of the carbonized acrylic fibers is higher than that of carbonized acrylic fibers manufactured by setting the temperature of the baths as high as possible or by raising the temperature of the baths in equal increments or with bath temperatures that result in an increase in fiber swelling from the previous bath.

The process can further include the step of relaxing stretching of the acrylic fibers in the last bath.

DETAILED DESCRIPTION OF THE INVENTION

Figure 1:
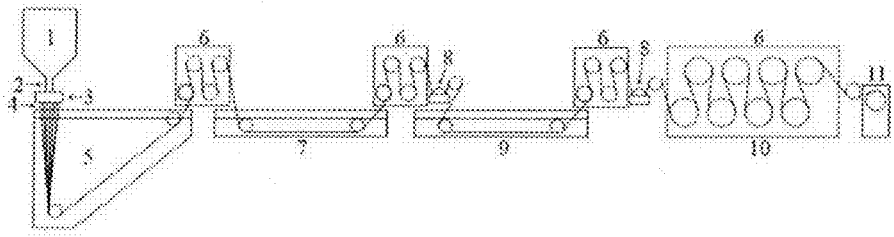
FIG. 1 illustrates an exemplary spinning process line.

Provided herewith is a process for producing carbon fibers having improved tensile strength during the spinning stage in the manufacture of carbon fibers. In conventional spinning processes, acrylic fiber is washed in one or more baths to remove solvent, and stretched upon exiting each bath. The present invention takes into consideration the swelling curves that describe the network density and porosity of the precursor fiber as it exits each successive bath.

According to the present invention, an acrylic polymer is spun in a coagulation bath, thereby forming acrylic fibers of single filaments. The acrylic fibers are then drawn in two or more baths, wherein in one or more baths the acrylic fibers are stretched and in the last bath the fiber is relaxed. The acrylic fiber is then stabilized and subsequently carbonized, forming carbon fibers. By relaxing the acrylic fiber in the last bath, the Young's or tensile modulus of these carbonized acrylic fibers is higher than that of carbonized acrylic fibers wherein the acrylic fibers are stretched in the last bath.

In a further embodiment of the process according to the present invention, the temperature of the first bath is set so that the degree of swelling of the acrylic fibers upon exit from the first bath is less than or equal to the degree of swelling of the acrylic fibers upon exit from the last bath.

In another embodiment, the present invention provides a process for producing carbon fibers during the spinning stage of the carbon fiber manufacturing process. According to this process, acrylic polymer is spun in a coagulation bath, thereby forming acrylic fibers of single filaments. The acrylic fibers are then drawn in two or more baths, wherein the temperature of the first bath is such that the degree of swelling of the acrylic fibers upon exit from the first bath is less than or equal to the degree of swelling of the acrylic fibers upon exit of the fiber from the coagulation bath. Subsequent bath temperatures are also selected so that the resulting fiber swelling is less than or equal to the swelling of the fiber from the previous bath. The acrylic fibers are then stabilized and subsequently carbonized to produce the carbon fibers. It has been discovered that carbonized acrylic fibers made by this process have a tensile strength higher than that of carbonized acrylic fibers manufactured by setting the temperature of the baths as high as possible or by raising the temperature of the baths in equal increments. In a further embodiment of this process, the stretching of the acrylic fibers is relaxed in the last bath.

Fiber swelling typically increases about 5 to about 20 units in the first draw bath when using a bath temperature of 60° C. It is believed that this loss of network density is destructive to the tight, fibrillar structure believed to be necessary in order to achieve high tensile strength carbon fiber. By manipulating the bath temperatures in all the draw baths, it was found that one could maintain or make denser the fiber entering each bath and thereby avoid the potential downside of the loss of density in the intermediate draw baths. This is achieved without solvent removal issues or stretching issues. This "progressive densification" draw approach yields the same final fiber network density but without the potential detriment of an unnecessary loss of density in the intermediate draw baths.

Synthesis of PAN Polymer

PAN polymers can be made by suspension polymerization or solution polymerization. In solution polymerization, the acrylonitrile (AN) monomer is mixed with a solvent, and one or more co-monomers to form a solution. The solution is then heated to a temperature above room temperature (i.e., greater than 25° C.), for example, to a temperature of about 40° C. to about 85° C. After heating, an initiator is added to the solution to initiate the polymerization reaction. Once polymerization is completed, unreacted AN monomers are stripped off (e.g., by de-aeration under high vacuum) and the resulting PAN polymer solution is cooled down. At this stage, the PAN polymer is in a solution or dope form ready for spinning.

Suitable solvents for solution polymerization include dimethyl sulfoxide (DMSO), dimethyl formamide (DMF) and dimethyl acetamide (DMAc).

PAN polymer can also be made by suspension polymerization. To prepare the spinning dope, the resulting PAN can be dissolved in solvents such as dimethyl sulfoxide (DMSO), dimethyl formamide (DMF), dimethyl acetamide (DMAc), ethylene carbonate (EC), zinc chloride ($ZnCl_2$)/water and sodium thiocyanate (NaSCN)/water.

Co-monomers suitable for synthesis of PAN polymers can be one or more vinyl-based acids, including methacrylic acid (MAA), acrylic acid (AA), itaconic acid (ITA), vinyl-based esters (e.g., methacrylate (MA), methyl methacrylate (MMA), vinyl acetate (VA), ethyl acrylate (EA), butyl acrylate (BA), ethyl methacrylate (EMA)), and other vinyl derivatives (e.g., vinyl imidazole (VIM), acrylamide (AAm), and diacetone acrylamide (DAAm)).

PAN polymerization can be initiated by an initiator (or catalyst) of azo-based compound (e.g., azo-bisisobutyronitrile (AIBN), azobiscyanovaleric acid (ACVA), and 2,2'-azobis-(2,4-dimethyl) valeronitrile (ABVN), or others) or an organic peroxide (e.g., dilauroyl peroxide (LPO), ditert-butyl peroxide (TBPO), diisopropyl peroxydicarbonate (IPP), and others).

According to a preferred embodiment, PAN polymerization is carried out based on the following formulation, % by weight (wt %): >90% AN monomer; <5% co-monomer; <1% initiator, based on total weight of the components; and sufficient amount of solvent to form a solution containing 5 wt % to 28 wt % of final PAN polymer, preferably, 15 wt % to 25 wt %.

To make PAN white fibers, the PAN polymer solution (i.e., spin "dope") is subjected to conventional wet spinning and/or air-gap spinning after removing air bubbles by vacuum. The spin "dope" can have a polymer concentration from about 5% to about 28% by weight, preferably from about 15 wt % to about 25 wt %, based on total weight of the solution. In wet spinning, the dope is filtered and extruded through holes of a spinneret (made of metal) into a liquid coagulation bath for the polymer to form filaments. The spinneret holes determine the desired filament count of the PAN fiber (e.g., 3,000 holes for 3K carbon fiber). In air-gap spinning, a vertical air gap of 1 to 50 mm, preferably 2 to 15 mm, is provided between the spinneret and the coagulating bath. In this spinning method, the polymer solution is filtered and extruded in the air from the spinneret and then extruded filaments are coagulated in a coagulating bath. A coagulation liquid used in the process is a mixture of solvent and non-solvent. Water or alcohol is typically used as the non-solvent. The ratio of solvent and non-solvent and bath temperature is used to adjust the solidification rate of the extruded nascent filaments in coagulation.

The spun filaments are then withdrawn from the coagulation bath by rollers through one or more wash baths to remove excess solvent and stretched in hot (e.g., 40° C. to 100° C.) water baths to impart molecular orientation to the filaments as the first step of controlling fiber diameter. The stretched filaments are then dried, for example, on drying rolls. The drying rolls can be composed of a plurality of rotatable rolls arranged in series and in serpentine configuration over which the filaments pass sequentially from roll to roll and under sufficient tension to provide filaments stretch or relaxation on the rolls. At least some of the rolls are heated by pressurized steam, which is circulated internally or through the rolls, or electrical heating elementals inside of the rolls. A finishing oil can be applied onto the stretched fibers prior to drying in order to prevent the filaments from sticking to each other in downstream processes.

Standard first draw bath temperature profiles (60° C. for the first bath, and then increasing each subsequent bath by 10° C.) are adequate for stretching fiber with minimal flaws. However, use of such bath temperatures permit loss of network density (by increase in swelling) in the first and second draw baths. This loss in density is a type of flaw and is not desirable when high tensile strength is required for the resultant carbon fiber.

In order to overcome this loss in network density, it has now been discovered that by modifying the temperature of the baths, the degree of swelling can be reduced resulting in progressively densified [through the baths] acrylic precursor fiber. This reduction in swelling is believed to reduce fiber micro- and nano-scale flaws. Surprisingly, the resultant carbon has higher tensile strength than that of carbon fiber manufactured using standard draw bath temperatures, yet retains the same Young's modulus.

In addition to having a first draw bath different from that of the standard first draw bath, it has now been discovered that the Young's modulus of the fiber can be increased by relaxing the stretching of the fiber out of the last draw bath. Typically, the length of acrylic fiber is stretched after exiting each bath. By relaxing the stretch of the fiber out of the last bath, tensile modulus of the fiber is increased.

As the second step of controlling fiber diameter, a superstretch follows the first fiber draw. This superstretch process is performed above the glass transition temperature of fiber at a temperature of about 100° C. to about 185° C., preferably at about 135° C. to about 175° C. Such stretch further orientates the molecules and crystalline domains in the filaments. The superstretched fiber can have a diameter of about 0.4 to about 1.5 denier, preferably about 0.5-1.0 denier.

Processing conditions (including composition of the spin solution and coagulation bath, the amount of total baths, stretches, temperatures, and filament speeds) are correlated to provide filaments of a desired structure and denier. Following the superstretch step, the fiber filaments can pass over one or more hot rolls and then can be wound onto bobbins.

To convert the PAN white acrylic fibers into carbon fibers, the PAN fibers are subjected to oxidation and carbonization. During the oxidation stage, the PAN fibers are fed under tension through one or more specialized ovens, into which heated air is fed. The oxidation oven temperature may range from 200° C. to 300° C., preferably 220 to 285° C. The oxidation process combines oxygen molecules from the air with the PAN fiber and causes the polymer chains to start crosslinking, thereby increasing the fiber density to 1.3 $g/cm^3$ to 1.4 $g/cm^3$. In the oxidization process, the tension applied to fiber is generally to control the fiber drawn or shrunk at a stretch ratio of 0.8 to 1.35, preferably 1.0 to 1.2. When the stretch ratio is 1, there is no stretch. And when the stretch ratio is greater than 1, the applied tension causes the fiber to be stretched. Such oxidized PAN fiber has an infusible ladder aromatic molecular structure and it is ready for carbonization treatment.

Carbonization occurs in an inert (oxygen-free) atmosphere inside one or more specially designed furnaces. In a preferred embodiment, the oxidized fiber is passed through a pre-carbonization furnace that subjects the fiber to a heating temperature of from about 300° C. to about 900° C., preferably about 350° C. to about 750° C., while being exposed to an inert gas (e.g., nitrogen), followed by carbonization by passing the fiber through a furnace heated to a higher temperature of from about 700° C. to about 1650° C., preferably about 800° C. to about 1450° C., while being exposed to an inert gas. Fiber tensioning should be added throughout the precarbonization and carbonization processes. In pre-carbonization, the applied fiber tension is sufficient to control the stretch ratio to be within the range of 0.9 to 1.2, preferably 1.0 to 1.15. In carbonization, the tension used is sufficient to provide a stretch ratio of 0.9 to 1.05. Carbonization results in the crystallization of carbon molecules and consequently produces a finished carbon fiber that has more than 90 percent carbon content.

Adhesion between the matrix resin and carbon fiber is an important criterion in a carbon fiber-reinforced polymer composite. As such, during the manufacture of carbon fiber, surface treatment may be performed after oxidation and carbonization to enhance this adhesion.

Surface treatment may include pulling the carbonized fiber through an electrolytic bath containing an electrolyte, such as ammonium bicarbonate or sodium hypochlorite. The chemicals of the electrolytic bath etch or roughen the surface of the fiber, thereby increasing the surface area available for interfacial fiber/matrix bonding and adding reactive chemical groups.

Next, the carbon fiber may be subjected to sizing, where a size coating, e.g. epoxy-based coating, is applied onto the fiber. Sizing may be carried out by passing the fiber through a size bath containing a liquid coating material. Sizing protects the carbon fiber during handling and processing into intermediate forms, such as dry fabric and prepreg. Sizing also holds filaments together in individual tows to reduce fuzz, improve processability and increase interfacial shear strength between the fiber and the matrix resin.

Following sizing, the coated carbon fiber is dried and then wound onto a bobbin.

Carbon fibers produced from the above-described PAN polymers have been found to have the following mechanical properties: tensile strength of greater than 700 Ksi (4826 MPa) and tensile initial modulus of greater than 40 Msi (275 GPa), per ASTM D4018 test method.

The benefits and properties of the above-described PAN polymer and carbon fibers produced therefrom will be further illustrated by the following Examples.

EXAMPLES

Example 1

Synthesis of Dope for Spinning

PAN polymers were prepared according to the formulations for PAN polymerization shown in Table 1.

TABLE 1

Formulations for PAN polymerization

| Components | Formulation 1 | Formulation 2 | Formulation 3 |
|---|---|---|---|
| Acrylonitrile (AN) | 99.30 | 99.00 | 98.00 |
| Itaconic acid (ITA) | 0.70 | 1.00 | — |
| Methacrylic Acid (MAA) | — | — | 2.0 |

Azo-bisisobutyronitrile (AIBN) was used as an initiator/catalyst and DMSO as solvent. During polymerization, the following sequence of steps was carried out:

a) Metering DMSO from DMSO storage tank to a reactor, then AN from AN storage tank to the reactor;
b) Purging reactor with nitrogen;
c) Preheating reactor and adding co-monomers into reactor at above room temperature (25° C.);
d) Heating the solution and then adding initiator/catalyst at desired temperature point of 40-85° C.;
e) Starting polymerization for time of 8-24 hours at temperature of 60-80° C.;
f) Cooling down to temperature of 40-50° C. and discharging the polymer solution.

Following polymerization, the molecular weights and PDI of the produced PAN polymers were measured and the results are shown in Table 2.

TABLE 2

Polymer molecular weights and distribution - Typical Ranges

| | Formulation 1 |
|---|---|
| Mn (g/mole) | 50-90 |
| Mw (g/mole) | 130-170 |
| Mw/Mn | 1.5-2.5 |
| Mz | 210-260 |

Gel Permeation Chromatography (GPC) was used to analyze the resultant PAN polymers for their molecular weights and polydispersity index (PDI). Viscotek GPCmax/SEC Chromatography System with low angle and right angle light scattering detectors and RI detector was used. Data were collected and analyzed using Viscotek OMNISEC Version 4.06 software for the absolute weight-average molecular weight (Mw) and its distribution determination.

All PAN polymers produced from Formulations yielded PAN polymers with PDI (Mw/Mn) of around 1.5 to 2.5.

Example 2

Fabrication of PAN Precursor Fiber

As shown in FIG. 1, PAN dope [1] is typically extruded through a filter [2] to capture any gels or other contaminants before being discharged through a spinneret [3] that has multiple capillaries. The PAN dope exits each spinneret capillary as a continuous stream of filtered and metered PAN dope into a space of ambient air or other gas separating the spinneret and the coagulation bath liquid surface. This air gap [4] typically ranges between 2-10 mm and allows the PAN dope temperatures to be controlled and manipulated separately from the coagulation bath temperature. The coagulation bath [5] is a liquid bath comprised of solvent and non-solvent whereby the concentration and temperature is manipulated and controlled so that the coagulation rate of PAN and the resulting fiber structure is controlled. The coagulated fiber exits the coagulation bath and enters a series of one or more heated liquid washing baths [7] and heated stretching baths [9]. Driven rolls [6] are used to control the fiber speed at the various stages of washing and stretching and impose stretch or relaxation on the fibers as desired. The washing and stretching baths allow for the substitution of solvent from the coagulated fiber with water while simultaneously stretching and orienting the fiber. After exiting the washing and stretching baths, the fiber typically has a spin finish applied [8] to minimize fiber damage and fiber sticking in subsequent process steps. After the spin finish is applied, the tow is dried, relaxed and any void structure collapsed on heated rolls [10]. Additional stretching, relaxation and spin finish application steps are possible after drying and before winding [11].

PAN polymer produced from Formulation 1 as described in Example 1 was used to form carbon fiber precursors (or white fibers) by air-gap spinning method with 138 μm spinneret.

Comparative/Control

PAN polymer produced from Formulation 1 was spun into acrylic fibers in a coagulation bath. The fiber was then drawn through a series of four baths. Temperature of the baths, stretch of the fibers and percentage swelling is provided in Table 3 below.

Progressive Densification

PAN polymer produced from Formulation 1 was spun into acrylic fibers in a coagulation bath. The fiber was then drawn through a series of four baths. Temperature of the baths, stretch of the fibers and percentage swelling is provided in Table 3 below.

TABLE 3

Control Swelling during Spin versus Progressive Densification

| Description | | Coag Bath | Bath 1 | Bath 2 | Bath 3 | Bath 4 |
|---|---|---|---|---|---|---|
| Control without Relax | Temp (° C.) | — | 60 | 70 | 80 | 90 |
| | Stretch | — | wash | wash | wash | 1.5-3.5x |
| | Swelling (%) | 87 | 101 | 92 | 83 | 76 |
| Control with Relax | Temp (° C.) | — | 65 | 80 | 90 | 90 |
| | Stretch | — | wash | wash | 1.5-3.5x | relax |
| | Swelling (%) | — | — | — | — | — |
| Progressive Densification With Relax | Temp (° C.) | — | 75 | 80 | 90 | 95 |
| | Stretch | — | wash | wash | 1.5-3.5x | relax |
| | Swelling (%) | 89 | 83 | 88 | 82 | 75 |

Figure 2:
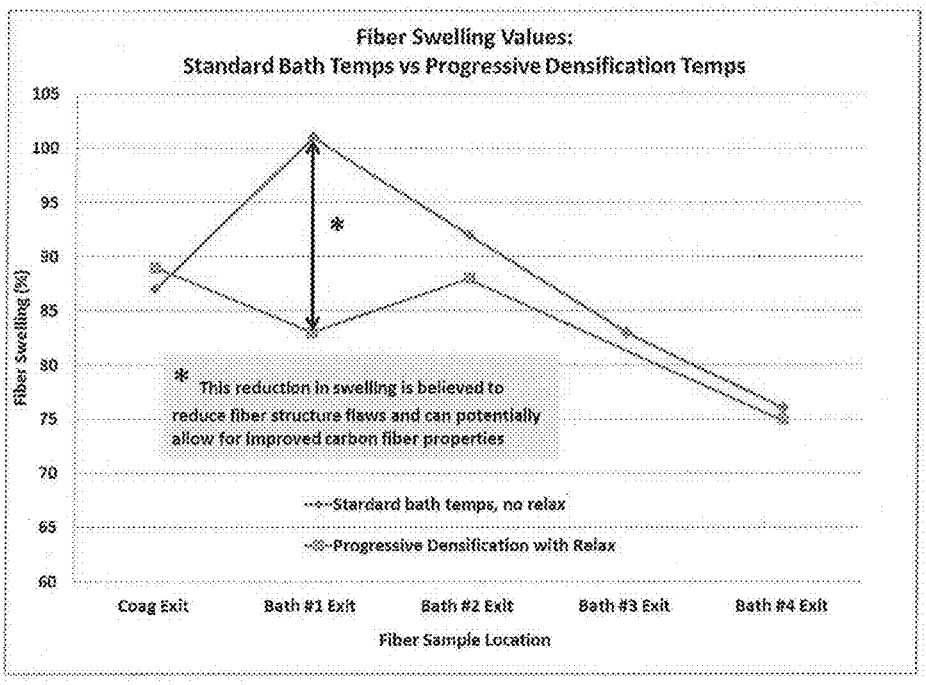
FIG. 2 is a graph illustrating the swelling percentage of the precursor fiber through the baths comparatively and according to the present invention.
Figure 3:
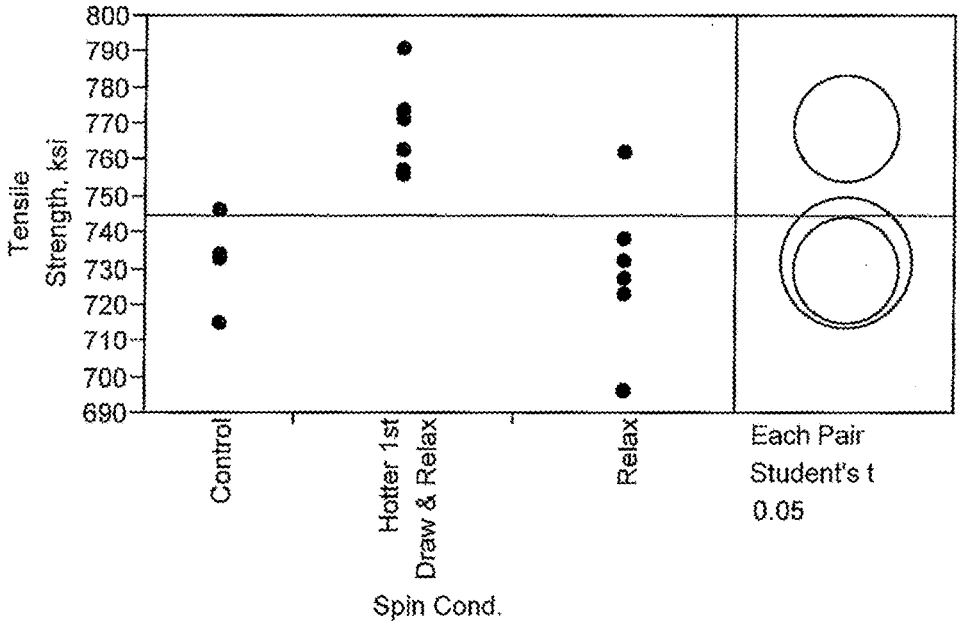
FIG. 3 is a chart comparing the tensile strength of precursor fiber made according to the present invention versus control precursor fiber and precursor fiber produced with a relax step.

Carbon fiber tensile strength data indicates the present progressive densification approach to be valid. Three runs were made for each process. FIG. 2 shows the swelling curves for the fiber at various stages of $1^{st}$ draw at standard conditions and at the progressive densification draw bath conditions. Average tensile strength for fiber made according to the control was 712 ksi. In contrast, average tensile strength for fiber made according to the present progressive densification technique was 744 ksi, giving an average increase in carbon fiber tensile strength of about 30 ksi. FIG. 3 shows the comparison of carbon fiber tensile strength for WF made during the same trial. The progressive densification condition in FIG. 3 is referred to as "Hotter $1^{st}$ Draw & Relax".

The $1^{St}$ draw bath temperatures should be set such that there is an increase from the 1st through the $4^{th}$ bath. The $1^{st}$ bath temperature should be 70-80° C., preferably 75° C. The $2^{nd}$ bath should be 75-85° C., preferably 80° C. The $3^{rd}$ bath should be 85-95° C., preferably 90° C. and the $4^{th}$ bath should be 90-100° C., preferably 92-95° C. The table below summarizes bath temperatures and preferred stretch distribution.

TABLE 4

Preferred Bath Temperatures and Stretch Distributions

| Bath # | Preferred Bath Temperature | Most Preferred Bath Temperature | Preferred Draw Ratio | Most Preferred Draw Ratio |
|---|---|---|---|---|
| 1 | 70-80° C. | 75° C. | 1.0-2.0 | 1.0-1.25 |
| 2 | 75-85° C. | 80° C. | 1.0-2.0 | 1.0-1.25 |
| 3 | 85-95° C. | 90° C. | 1.5-4.0 | 1.25-2.0 |
| 4 | 90-100° C. | 92-95° C. | 0.95-1.20 | 0.90-1.0 |

Properties of the white precursor fibers were determined as follows.

Porosimetry

For air-gap spinning, fiber sample exiting coagulation bath was freeze-dried at −60° C. and the freeze-dried sample was tested by a mercury porosimeter for porosity and porous structure analysis.

TABLE 5

Fiber Density Results

| Sample ID | OX Fiber Yield (g/m) | OX Fiber Density (g/cm$^3$) | CF Yield (g/m) | CF Density (g/cm$^3$) | % Sizing |
|---|---|---|---|---|---|
| Control without Relax | — | 1.341 | 0.113 | 1.810 | 0.88 |
| Control with Relax | 0.220 | 1.351 | 0.111 | 1.808 | 0.87 |
| Progressive Densification with Relax | 0.223 | 1.350 | 0.111 | 1.812 | 0.88 |

PAN polymers based on Formulation 1 was found to have good spinning ability.

Converting White Fibers into Carbon Fibers

The white fiber precursors were oxidized in air within the temperature range of 220° C.-285° C., and carbonized in nitrogen within the temperature range of 350° C.-650° C. (pre-carbonization) and then 800° C.-1300° C.

Tensile strength and tensile modulus of the resulting carbon fibers were determined and are shown in Table 6.

TABLE 6

Carbonization & carbon fiber properties

| Fiber | Control | Progressive Draw |
|---|---|---|
| Oxidization temperature (° C.) | 220-285 | 220-285 |
| Pre-carbonization temperature (° C.) | 350-650 | 350-650 |
| Carbonization temperature (° C.) | 800-1300 | 800-1300 |
| Fiber tensile strength (ksi) | 712 (4909 MPa) | 744 (5129 MPa) |
| Fiber tensile modulus (Msi) | 41.9 (289 GPa) | 43.0 (296 GPa) |
| Fiber density (g/cm$^3$) | 1.809 | 1.822 |

Carbon fiber's tensile strength and initial modulus was determined per ASTM D4018. The carbon fiber was first impregnated into an epoxy resin bath and then cured. The cured carbon fiber strand is tested on MTS under 0.5 in/min crosshead speed for its tensile strength and modulus. Fiber density was determined by liquid immersion method per ASTM D3800.

While the invention has been described with reference to a preferred embodiment, it will be understood by those skilled in the art that various changes may be made and equivalents may be substituted for elements thereof without departing from the scope of the invention. Further, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process for producing carbon fibers comprising:

spinning an acrylic polymer in a coagulation bath, thereby forming acrylic fibers of single filaments;

drawing the acrylic fibers from the coagulation bath in two or more additional baths, including a first bath and a second bath, wherein the temperature of the two or more additional baths is such that fiber density as measured by swelling of the acrylic fibers upon exit from the second bath is less than the fiber density as measured by swelling of the acrylic fibers upon exit from the first bath; and stabilizing and subsequently carbonizing the acrylic fibers.

2. The process of claim 1, wherein the two or more additional baths includes a last bath, and the process further comprising relaxing the acrylic fibers in the last bath.

3. A process for producing carbon fibers comprising:

(a) spinning an acrylic polymer in a coagulation bath, thereby forming acrylic fibers of single filaments;

(b) drawing the acrylic fibers through a series of four heated baths, wherein the temperature of the baths increases from the first bath to the fourth bath with the temperature of the first bath being in the range of 70° C.-80° C., the temperature of the second bath being in the range of 75° C.-85° C., the temperature of the third bath being in the range of 85° C.-95° C., and temperature of the fourth bath being in the range of 90° C.-100° C., and the drawing ratios of the fibers in the baths are as follows: 1.0-2.0 in first bath; 1.0-2.0 in second bath; 1.5-4.0 in third bath; 0.95-1.20 in fourth bath, wherein the fiber density of the acrylic fibers exiting the second bath is less than the fiber density of the acrylic fibers exiting the first bath;

(c) oxidizing in air the acrylic fibers exiting from the fourth bath within the temperature range of 220° C.-285° C. to form oxidized fibers; and (d) carbonizing the oxidized fibers in nitrogen within the temperature range of 350° C.-650° C. and then 800° C.-1300° C.

4. The process of claim 3, wherein the drawing ratios of the fibers in the baths are as follows: 1.0-1.25 in first bath; 1.0-1.25 in second bath; 1.25-2.0 in third bath; 0.90-1.0 in fourth bath.

* * * * *